United States Patent [19]

Vanneste

[11] Patent Number: 4,767,472

[45] Date of Patent: Aug. 30, 1988

[54] METHOD FOR THE TREATMENT OF STEEL WIRES

[75] Inventor: Golfried Vanneste, Ingelmunster, Belgium

[73] Assignee: N. V. Bekaert S.A., Zwevegem, Belgium

[21] Appl. No.: 56,285

[22] Filed: May 29, 1987

Related U.S. Application Data

[63] Continuation of Ser. No. 903,232, Sep. 3, 1986, abandoned.

[30] Foreign Application Priority Data

Sep. 27, 1985 [GB] United Kingdom ..... 8523882

[51] Int. Cl.[4] ..... C21D 9/52

[52] U.S. Cl. ..... 148/156

[58] Field of Search ..... 148/18, 20.6, 27, 28, 148/156, 128, 157, 143, 153, 155

[56] References Cited

U.S. PATENT DOCUMENTS 4,238,119 12/1980 Mitsuyushi ..... 266/100

4,395,022 7/1983 Paulus et al. ..... 266/112

4,526,627 7/1985 Iwata et al. ..... 148/12 B

FOREIGN PATENT DOCUMENTS 1942731 4/1971 Fed. Rep. of Germany ..... 148/28

OTHER PUBLICATIONS

Metals Handbook, vol. 4, Heat Treating pp. 39–41, © 1981.

*Primary Examiner*—Christopher W. Brody

*Attorney, Agent, or Firm*—Foley & Lardner, Schwartz, Jeffery, Schwaab, Mack, Blumenthal & Evans

[57] ABSTRACT

Steel wires W are 'patented' by heating in a furnace 6 to the austenitization temperature and then cooled to a range in which austenite is transformed into pearlite by passing the wires through a water cooling device 1. This cooling device comprises a tank 2 through which very pure water is continuously circulated at a temperature of at least 85° C. The high purity of the water permits very stable film boiling conditions to occur on the surface of the wire resulting in a soft pearlite structure of excellent drawability.

16 Claims, 3 Drawing Sheets

T, °G 900
800
700
600
500
400
X₀
a
X₁
X'₁
a₁
X₂
X'₂
a₂
X₃
a₃
Tc
t₁
t₂
t₃
tc
t

T, °G 900
800
700
600
500
400
a
f
a₁
a₂
a₃
b₁
Tc
F
S
t

METHOD FOR THE TREATMENT OF STEEL WIRES

This application is a continuation of application Ser. No. 903,232, filed Sept. 3, 1986 now abandoned.

This specification relates to the field of steel wire heat treatment in the art of wire-making. In particular it refers to a method and apparatus of direct wire cooling in line with prior heating.

The manufacture of steel wire normally begins with a hot-rolled rod of about 5,5 mm (or larger) diameter, which has been treated to a deformable pearlitic state in a rod mill. This treatment usually involves a controlled forced air cooling of the hot rod transported in Spencerian loops on a conveyor, e.g. by the well-known Stelnor process or variants thereof. In some cases the direct heat treatment of wire rod moved in spiral coils through a cooling zone, is carried out with a liquid coolant.

The first step in wire-making starts with drawing a rod to a desired intermediate diameter which can vary from 1,5 to 4 mm. At this stage of work-hardening the drawn wires are heat treated to pearlite by a patenting process to enable further plastic deformation. Subsequently, the patented steel wires are drawn to a smaller size, either a second intermediate size or a final diameter.

Patenting involves heating carbon steel wires into the austentic phase, generally above 800° C. and then quenching the wires to a chosen temperature held for a sufficient period for generally isothermal decomposition of the austenite to be completed. The temperature is usually in the region of 550° C., with the intention being generally to provide a fine pearlite structure.

In a conventional patenting operation the quenching and transformation steps are carried out in a bath of molten lead held at a constant temperature. Although this provides good results in view of the heat absorbing capacity of the molten lead, which gives rise to rapid cooling, there are problems. Apart from the environmental and safety problems of working with molten lead, there can be lead drag out and surface defects caused by lead contamination.

In the past certain methods involving the use of aqueous cooling media have been proposed for direct heat treatment of hot rolled steel rod in order to obtain suitable pearlite structures comparable to those realisable by Stelmor cooling and the like.

Among these methods of rod cooling one may find, for example, proposals relating to hot water quenching in a prescribed temperature range, either vertical batch quenching of rod coils or horizontal quenching of continuously moving spiral loops. One also encounters the use of liquid coolants consisting of hot aqueous salt solutions. Further there are trials in which polymeric or surface tension increasing substances are employed as additives in the water coolant for a better control of frequently violent boiling phenomena that occur and even attempts combining hot water and gas bubbling to increase the cooling rate. These methods have various merits when used in the direct cooling of hot rolled rods transported in spiral coils on a horizontal conveyor. Indeed the use of subcooled boiling liquids for direct cooling of hot rods is not so much a critical process (since there is an absence of martensite formation owing to the elevated heat content and large rod size) as a slow process, and most further developments are aimed at increasing heat transfer. Up to now these methods have been regarded as being less suitable or unreliable for wire treatment.

Prior attempts to use the aforementioned methods for the purpose of effecting the cooling-transformation of drawn and austenitized steel wires to pearlite, have been largely unsuccessful in many respects. The results of the heat treatment are too often unreliable and the treated wires show too high a variation in properties such as inconsistent drawability and frequently unexpected brittle behaviour. This is not so surprising given the considerable difference in diameter and oxide scale thickness between rod and wire. The absence of relatively thick surface scales and the comparatively low heat content of hot wires cause a quicker drop in wire temperature resulting in undesirable martensite forming quenching if the required conditions of stable film boiling cooling are not fulfilled. This implies that small variations in the cooling rate may become critical inducing unexpected nucleate boiling and related quenching effects. In addition, incidental and local breakdown of homogeneous film boiling behaviour (which is likely to occur more frequently with small wire sizes) has a more direct detrimental effect since it results in the formation of hard spots of martensite and bainite on the wire surface.

The need for stable film boiling to carry out reliable wire transformation-cooling has been thought, at least by some, to be an insurmountable problem for practical purposes, given the random nature of the observed hard spots and defective areas which could not be correlated to one or another single coolant factor. Because of this lack of control and consistency, it has for a long time been assumed that the cooling transformation of wires in a water coolant is not a practical proposition.

In an attempt to establish adequate film boiling conditions, there have been proposals to use special additives and also proprietary aqueous polymeric quenching media. In normal production practice, however, these measures considerably increase the cost of heat treatment owing to the consumption of expensive quenching media. Also the control of polymer or additive concentration and increased environmental pollution pose great problems with these quenching media. A further drawback is that the stabilizing effect of the additives gradually deteriorates in time as a result of bath ageing and inevitable contamination.

Viewed from one broad aspect there is herein disclosed a method of controlled cooling of previously heated steel wire to a predetermined temperature range, wherein said wire is transported continuously through a coolant bath containing substantially pure water of at least 80° C. and is immersed in said bath so as to effect a required decrease in wire temperature, said wire being subjected to uniform and stable film-boiled cooling along its entire immersion length by contacting said wire with a continuous non-turbulent flow of said substantially pure water. By "substantially pure" is meant water having, as far as is practicable, no mineral or organic additives, and being free of solute and suspended impurities. This water may, for example, be in the form of demineralised water, distilled water, or water prepared from condensed steam.

Viewed from another broad aspect there is herein disclosed a cooling apparatus comprising; means for conveying a hot wire through a water coolant bath, a coolant reservoir and means for circulating the water coolant between said reservoir and said bath at a predetermined rate of feed, said coolant bath being an overflow immersion tank with continuous fluid circulation and appropriate level control, and comprises means to cause a non-turbulent flow of water around the immersed wire.

By this method and apparatus the wire is subjected to uniform and stable film-boiled cooling which substantially prevents local quenching and incidental nucleate boiling which would otherwise lead to undesirable martensite formation.

While this method may not always produce a pearlite structure of the same quality as that obtained from lead patenting, it has recently been established that a patenting treatment prior to a second drawing cycle (which is not necessarily the final drawing operation), is much less critical than generally assumed. Hence, the formation of fine homogeneous pearlite structure of the type obtained by optimum "isothermal" lead patenting is seldom required for further drawing and thus aqueous cooling might be suitable.

Preferably to carry out this method in the process of metallurgical patenting, a plurality of steel wires is first austenitized and then conveyed continuously along individual parallel paths to a coolant bath through which the wires are passed horizontally for a predetermined immersion length and wherein the wires, while so immersed, are contacted with a predominantly laminar flow of a water coolant having a constant temperature of at least 80° C. (more preferably not less than 85° C.) and possessing a sufficient purity so as to achieve and to maintain stable film boiled cooling without inducing local nucleate boiling and quench martensite formation, the wires being progresively cooled during immersion to a desired temperature range of pearlite transformation. The pearlite reaction, which may be initiated either in the coolant bath or outside the bath upon further cooling after immersion, usually occurs to the largest extent or completely outside the water coolant bath.

The immersion length is variable and can be specified in practice according to wire diameter, line speed and desired transformation range. The pearlite transformation, usually occurring to the largest extent after the wires have risen from the coolant bath, may be initiated in the coolant or shifted so as to proceed to a variable degree while the wires are immersed.

The steel wires that can be treated by the present method include plain carbon steels of medium to high-carbon content (from about 0.2 to over 1,2% C and most advantageously 0.45 to 0.95% C), and low-alloy carbon steels containing a small amount of an alloying element such as Mn, Si, Cr, Ni, V, Mo, Ti, Nb or W. Wire diameters may range from about 1.5 to 5 mm, the preferred range being comprised of the diameters 2.5 to 4.0 mm.

Preferably the wire has a temperture and size that provide sufficient heat content to preserve and sustain film boiling, in combination with a sufficiently high water temperature of at least 80° C., preferably not less than 85° C. and most preferably in the range 90°-95° C.

The flow of water contacting the wire is non-turbulent to prevent distortion of the delicate surface boiling wave or disruption of the fragile film to wire surface interface, and is of a sufficient purity, free of suspended particles, and containing a restricted amount of dissolved compounds.

Preferably the wire surface is regular and smooth, free of large asperities, dirt particles and excessive oxide scale; this surface oxide scale should be uniform and preferably be kept below a weight of 50 gram per square meter of wire surface and most preferably be in a range of abut 15-30 g/m$^2$ after the water patenting.

Ordinary tap water is not adequate for the method and unreliable in time because of the presence of impurities and minerals (with the inevitable gradual increase of calcareous and other deposits effecting film boiling stability). Similarly, the build-up of too high solute or salt concentrations can intensify precipitates effects around the wire, disturbing and sometimes even penetrating the boiling film (causing a local transition to nucleate boiling resulting in quench effects). Thick oxide scales are also to be avoided, not only because of their lower heat conductivity, but also because of the risk of local scale delamination or bursting and concomitant split-off of oxide particles which can easily penetrate the fragile boiling film and thereby produce locally quenched surface areas containing less deformable bainite and brittle martensite.

Accordingly a water coolant of specified purity is necessary, more in particular condensed steam or water of similar purity (e.g. demineralized water). In addition thereto a non-oxidizing furnace atmosphere is most desirable to control wire surface quality. Scaling during austenitization and wire oxidation should be avoided between furnace exit and water bath entry, e.g. by providing a protective hood between furnance and coolant bath so that the wires remain under a non-oxidizing gas from the furnace up to the point of being immersed in the cooling bath. In this way smooth and thin surface scales are obtainable which help to preserve film boiling cooling stability.

An embodiment of the broad aspects of this disclosure will now be described by way of example with reference to the accompanying drawings in which.

Figure 1:
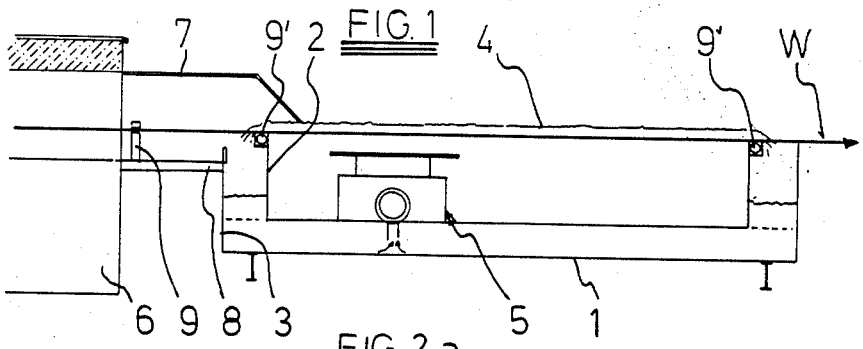
FIG. 1 is a schematic cross-sectional view of an apparatus implementing the method of direct cooling-transformation

Referring now to the drawings, FIG. 1 represents a longitudinal plan view of an installation for patenting medium and high-carbon steel wires by a water cooling-transformation method. In FIG. 1 wires W are first austenitized in furnace 6, then travel through a protective hood 7 before horizontally dipping into the water bath 4 of a cooling device 1. The cooling device 1 comprises a water tank 2 with a continuous overflow to collector reservoir 3, wherein the water coolant is kept at a constant temperature with the liquid level being controlled by suitable means (not shown). From the reservoir the hot water is fed to the immersion tank 2 by supply, circulating and distributing means 5. A protective hood 7 links the furnace unit to the cooling device and is air-tight, e.g. by use of a water slot 8, to prevent inflow of ambient air. Wire W is kept straight and horizontal by suitable pulling-conveying means (now shown) and supporting means 9 and 9' arranged at the entry and exit of the bath.

Figure 2A:
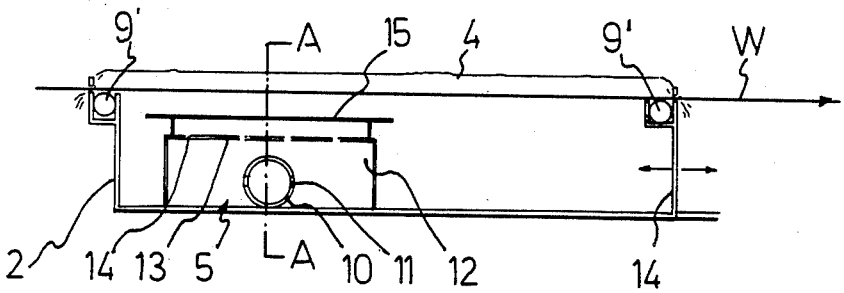
FIG. 2 is a more detailed view showing a preferred embodiment of a cooling device, respectively in the transverse and longitudinal direction thereof, for carrying out the film boiling cooling method.
Figure 2B:
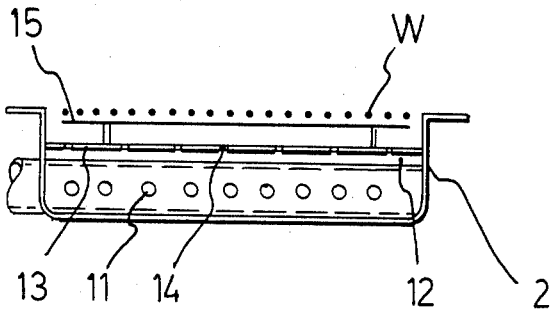

FIG. 2 shows the cooling bath construction 2 in greater detail, with FIG. 2*a* illustrating a plan view of a longitudinal section in the wire direction and FIG. 2*b* giving a transverse section along line A—A of said longitudinal view. As can be seen, wires W pass entirely immersed through coolant bath 4 from entry to exit supports 9. The coolant feed system 5 comprises a large diameter intake pipe 10 with lateral opening 11, flowing into a submerged and largely closed chamber 12, which feeds the intake water to bath 4 through a perforated top plate 13 containing a plurality of orifices 14. By means of these submerged orifices the water supply is evenly distributed without turbulence in the coolant bath. An intermediate plate 15 located at an adjustable height above the orifice plate 13 prevents the wires being directly subjected to rising coolant, so as to ensure a quasi-laminar flow contact in the proper cooling section. Feed pipe 10 is connected to a circulation pump and supply duct (not shown here) linking collecting reservoir 3 (shown in FIG. 1 but not represented here) to cooling tank 2. The wire immersion length is adjustable, either by arranging a sliding or movable exit wall member 14 to by otherwise providing means (e.g. movable/liftable exit support 9') for adjusting the wire immersion length.

Figure 2C:
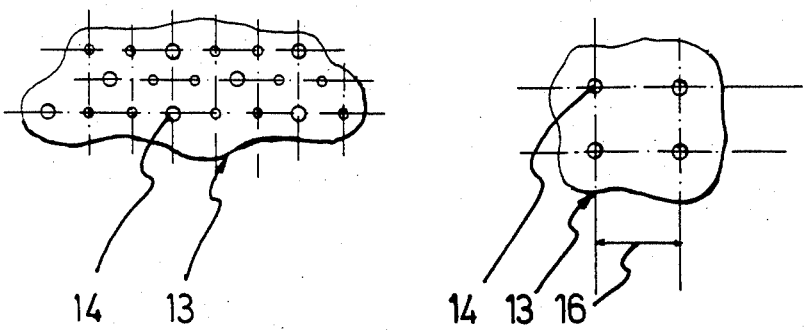

In FIG. 2*c* there are shown 2 suitable patterns of a perforated distribution plate, containing a large number of orifices for creating a smooth, non-turbulent coolant supply.

In an industrial installation for treating a large number of wires, e.g to cool simultaneously 30 or 40 wires of 3–3,5 mm from a temperature of above 850° C. to a patenting temperature of about 550° up to less than 700° C., a coolant circulation of about 50 $m^3$ per hour may be sufficient; the coolant flow rate through the multi-hole distribution plate is preferably kept below 0.5 m per second so that quasi-laminar flow conditions are maintained in the wire immersion zone.

In carrying out this cooling-transformation method as a substitute for a conventional patenting treatment, the immersed wires are allowed to cool from austenitization temperature to a predetermined end cooling temperature and then reacted to pearlite, whereby the major part of transformation takes place outside the coolant bath, e.g. in ambient air. Depending on the actual immersion length, longitudinal wire speed and average cooling rate (in turn depending on the coolant temperature and wire diameter), a specified cooling-transformation range can be imposed. Because the wire cooling range at the end of immersion is easily adjustable in a wide range, say from abut 540°–550° to 680°–690° C., by simply changing the immersion length, sufficient control of the pearlite reaction range is possible. Austenite decomposition may already be initiated in the coolant, though when a large part of austenite decomposition takes place while the wires are immersed, e.g. when employing a long water bath, it is to be emphasized that the necessary conditions of stable film boiling are even more stringent due to the greater risk of quench martensite formation. In industrial high-speed operations of intermediate patenting, where the finest pearlite structure is not required (sometimes even undesired), the proper transformation part of the cooling-transformation treatment will usually start when the wires have left the coolant bath, e.g. in still air. After the water cooling bath, one can optionally provide an insulated tunnel or temperature stabilizing chamber wherein the wires, precooled to a prescribed transformation range, are reacted to pearlite.

Reference will now be made to certain examples:

EXAMPLE 1

Steel wires of 3.10 mm with 0.65% C were austenitized in a gas-fired direct flame furnace at a temperature of about 950° C. and subjected to a cooling-transformation treatment at a speed of abut 40 m per minute.

Combustion was regulated to have a non-oxidizing furnace atmosphere, containing 3% of CO measured under the protective hood. The cooling-transformation was carried out with a device as described above and illustrated in FIGS. 1 and 2. Water coolant (of the quality of distilled water) was kept at a temperature of 91°–93° C., and after a water bath immersion of about 4 m, the wires were allowed to cool further in ambient air.

Figure 3:
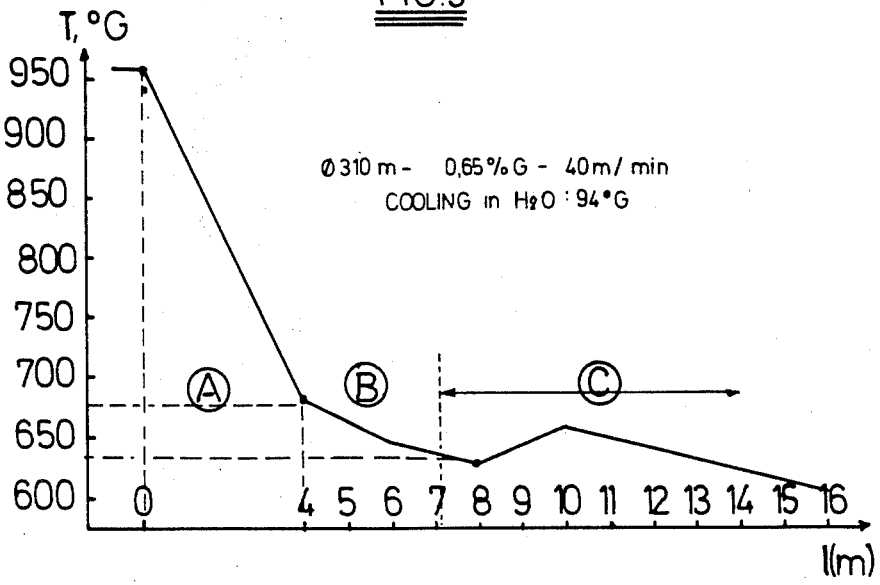
FIG. 3 is a graph showing the evolution of wire temperture when applying thereon the cooling-transformation treatment.

The change of wire temperature upon water cooling and subsequent transformation in air is depicted in FIG. 3.

In FIG. 3 wire temperature is plotted as a function of the distance L (from) the coolant bath entry.

Region A corresponds to water cooling, B to further air cooling and C to pearlite transformation.

From these observations it can be concluded that in the above conditions the wires have a temperature of about 670° C. on leaving the water bath, and that the entire pearlite transformation occurs in the air a few meters afterwards in a temperature range of approximately 640°–670° C.

The resulting wire properties were as follows:

Tensile strength of water patented wire: 1080N/$mm^2$.

Microstructure: sorbite and coarse lamellar pearlite.

Drawability: very good without occurrence of wire breaks.

An industrial test in the same conditions with 25 tons of wire revealed the very satisfactory reliability of the process.

Stable film boiling was maintained with a total absence of black quench spots on the wire surface. During further drawing the so processed wire revealed equal or better performance than conventionally lead patented wires in terms of wire breaks, consumption of die material and scrap ratio (0.3 to 1.0% as compared to usual reject figure of 0.5 to 1.3).

EXAMPLE 2

Steel wire of 1.75 mm with 0.55% C was subjected to a cooling transformation in 2 types of water coolant at varying temperatures.

Austentization was carried out at 940° C. under cracked ammonia.

Cooling with ordinary tap water at temperatures between 80° and 90° C. resulted in highly fluctuating tensile and structural wire properties showing frequently brittle behaviour.

Above a water temperature of 90° C. the occurrence of martensitic areas was greatly eliminated during short trials. However, with increasing processing time, brittle places appeared again, and the so treated wires were unfit for uninterrupted further drawing.

Cooling with high-purity water, such as distilled water, was found to give satisfactory results above 85° C. Full process reliability and optimum wire properties were obtained between 90° and 95° C. When cooled in water at 94° C. with an immersion time of 2.8 seconds wire properties were achieved as in normal lead patenting (sorbite structure; tensile strength of about 1000 $N/mm^2$).

EXAMPLE 3

High-carbon 0.90% C, steel wire of 2.5 mm diameter was austenitized at 960° C. and reacted to pearlite by passing the wire through a water coolant device as herein disclosed.

Adequate patenting results were obtainable with a coolant temperture comprised in the range 85°–96° C. Depending on the immersion time used the as patented tensile strength could be varied from 1250 $N/mm^2$ (3.0–4 seconds) to 1400 $N/mm^2$ (6.0–7 seconds).

Above a coolant temperature of about 96° C. it becomes increasingly difficult to supply the desired constant rate of constant coolant circulation because boiling phenomena in the supply water may become excessive thereby affecting pumping load and related feed rate. Below 85° C. there is an increasing risk of local quench effects when treating usual wire diameters (1,5–4 mm) in industrial practice, due to unavoidable incidental imperfections of wire surface and coolant quality. Thus, in the required coolant temperature range of 80° C. up to about the boiling point, the temperature is preferably higher than 85° C. A preferred range is 88° to 98° C. and a most preferred water temperature range 90° to 96° C.

It should be appreciated that in applying this cooling-transformation method to the patenting process of steel wire, one has a large flexibility in choosing the end point of water cooling according to the desired wire strength and pearlite structure needed for further drawing. This is illustrated in FIG. 4 and FIG. 5.

Figure 4:
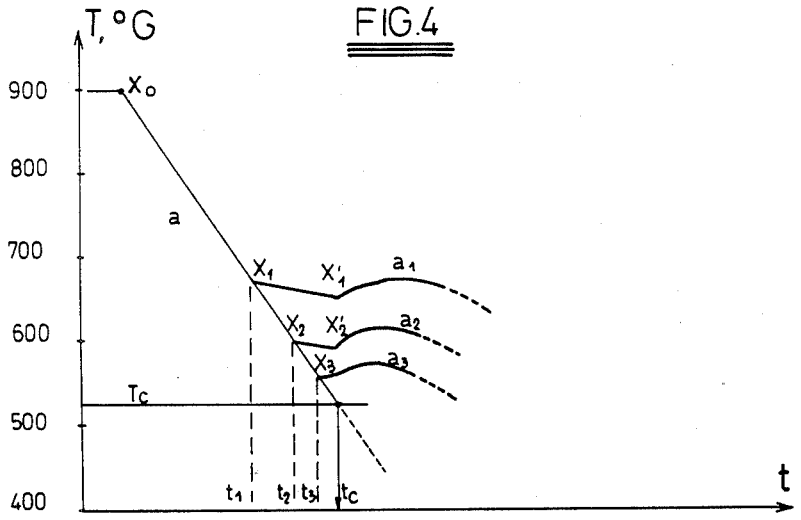
FIG. 4 is a schematic diagram showing a set of wire cooling-transformation curves related to different end points of wire cooling in the water coolant.
Figure 5:
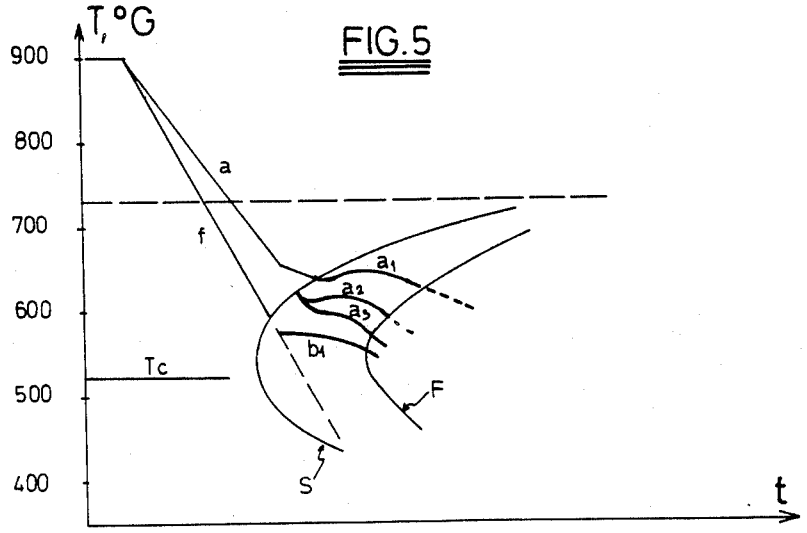
FIG. 5 is a T.T.T. diagram of a high-carbon steel showing therein the cooling-transformation curves obtainable by the method.

FIG. 4 refers to practical possibilities of intermediate water patenting effected on 0.7 C steel wires of 3.25 mm diameter which are subjected to stable film boiled cooling in condenser water of 95° C.

In FIG. 4 line a represents the continuous nearly linear decrease in wire temperature with increasing immersion time t to length X in the subcooled boiling water. Xo represents the start of water cooling and the points X1, X2 and X3 represent the end point of wire immersion (residence times t1, t2, t3) and the corresponding curves a1, a2 and a3 show the normally expected subsequent change in wire temperture with further ambient air cooling and superimposed transformation. In curve a1 there can be seen a first part X1X'1 of slow temperature drop, related to air cooling before the start of austenite decomposition at X'1.

Curve a3, referring to a wire cooling-transformation with prior water cooling down to a point A3 located around 550° C. shows a transformation which may already be initiated while the wire is still immersed. The slope of cooling line a depends on the wire diameter and to a lesser extent on water temperature, since said temperature can only be varied in a rather narrow range of about 85° up to 95°–98° C. (usually 90° to 96° C.).

Temperature Tc (with immersion time tc) represents a critical level of wire temperature below which undesirable bainite or even matensite may be formed. Thus, a water cooling time t has to be selected so that the transformation temperature range stays well above Tc.

In FIG. 5 there is schematically shown a temperature-time-transformation diagram of eutectoid carbon steel, wherein curves S and F represent the onset and finish respectively of austenite decomposition. In the diagram there are drawn 2 cooling curves a and b corresponding to 2 different wire sizes cooled to different temperature end points with a water cooling device from which end points the wires are allowed to transform into pearlite (curves a1, a2, a3 and b1).

From the teachings of FIGS. 4 and 5 it can be concluded that water cooling provides a simplified and easily adaptable cooling-transformation method, which can replace conventional lead patenting of medium and high-carbon steel wires. However unlike lead patenting, the method is not a really isothermal transformation process, but a process of continuous-cooling transformation since the wire temperature decreases less abruptly from austenitization to transformation level and since the pearlite reaction occurs in a less narrow temperature range. As a consequence, water patented wires are somewhat softer and comparable to lead patented wires of a somewhat higher transformation range.

By using, for example, the combination of a water patenting apparatus in line with an insulated space (e.g. a flat tunnel chamber) disposed after the coolant bath, it is possible to largely prevent undesirable temperature variations during pearlite transformation, especially when treating wire diameters below 2,5 mm.

It will be seen that there is this provided, at least in preferred embodiments, apparatus suitable for carying out controlled-cooling of steel wire to pearlite comprising the combination of an austenitizing furance and a cooling device as herein disclosed, wire conveying and wire supporting means to transport a plurality of wires along a parallel rectilinear paths through the cooling device, preferably in a horizontal plane in line with the furnace (as opposed to the use of sinking rolls in a molten lead bath).

In this cooling apparatus there are incorporated specific means for achieving stable film boiling conditions and for ensuring the long lasting stability thereof in practical production circumstances, which means comprise a water coolant free of additives and having a sufficient purity, which coolant is kept at a subcooled boiling temperature of at least 80° C., an immersion overflow bath with particular water supply circulation system so as to contact the wires by a continuous laminar flow of hot water at substantially constant temperature, inclusive means for coolant heating and close temperature regulation and means for automatic adjustment of coolant level in the reservoir through addition of fresh coolant to compensate the continuous evaporation losses (which level adjustment should be fine enough to keep coolant temperature fluctuations within a narrow margin of preferably not more than plus-minus 2° C.)

Stable film boiling conditions are secured along the entire length of the immersed wires, and the delicate balance of film boiling is consistently preserved, even during long industrial operations and without the need to employ special polymer additives and the like surfactants in the water coolant.

It is possible to effect thereby a controlled cooling of austenitized carbon steel wires through a selected transformation range in order to restore their plastic deformation capacity after a prior cold working operation and to enable thereby subsequent wire drawing.

There is provided a simplified method and apparatus for performing the controlled cooling-transformation to pearlite of medium and high-carbon steel wires in a more economical way by using a water coolant technique. In conducting the wires thereby to a desired pealite microstructure of satisfactory drawability the method disclosed above can replace in certain circumstances conventional lead patenting.

The treated wires have a strength comparable to that achieved by isothermal patenting of identical wires in molten lead kept at a temperature corresponding to about the wire temperature at the end of the water cooling. The water patented wires feature a sufficiently uniform pearlitic microstructure with excellent drawability records.

Modifications to the specific embodiments and to any broad aspects thereof referred to or suggested herein may be apparent to those skilled in the art and the disclosure hereof is intended to encompass any such modifications. The claims presently appended hereto define those aspect(s) for which protection is being sought for the time being.

I claim:

1. A method of controlled cooling of previously heated steel wire to a predetermined temperature range, wherein said wire is transported continuously through a coolant bath containing substantially pure water of at least 80° C. and is immersed in said bath so as to effect a required decrease in wire temperature, said wire being subjected to uniform and stable film-boiled cooling along its entire immersion length by contacting said wire with a continuous non-turbulent flow of said substantially pure water.

2. A method according to claim 1, wherein the water coolant is at a substantially constant temperature of not less than 85° C.

3. A method according to claim 2, wherein the water temperature is between 88° C. and 98° C.

4. A method according to claim 3 wherein the water temperature is between 90° C. and 96° C.

5. A method according to any preceding claim wherein said water is continuously recirculated.

6. A method according to claim 1 wherein the water is prepared from condensed steam, or is demineralised water or distilled water.

7. A method according to claim 1 wherein the wire is transported along a generally horizontal path through the coolant bath.

8. A method according to claim 1, wherein the wire to be treated is medium or high-carbon steel wire of 0.2% C to 1.2% carbon and with a diameter from about 1.50 to 5 mm, and whereby said wire is subjected to a controlled cooling-transformation treatment from austenite to pearlite.

9. A method according to claim 8 wherein said wire is heated in an austenitization furnace located in line with said bath and conveyed therefrom through said bath.

10. A method according to claim 8 or 9 wherein said wire is cooled to a temperature between 500° C. and 700° C.

11. A method according to claim 10 wherein said wire is cooled to a temperture between 550° C. to 680° C.

12. A method according to claim 8 wherein the transformation from austenite to pearlite occurs substantially after the wire leaves the coolant bath.

13. A method according to claim 9, wherein the stability of the film-boiled water cooling is further improved by preventing and/or controlling wire surface oxidation before water cooling, by austenitizing the wire in a non-oxidizing atmosphere and keeping the wire under said atmosphere up to the point of water immersion.

14. A method according to claim 13 wherein the oxide scale of the finished wire surface has a weight of less than 50 $g/m^2$.

15. A method according to claim 14 wherein the oxide scale has a weight of less than 30 $g/m^2$.

16. A method according to claim 7, wherein the wire is guided along a rectilinear path.

* * * * *